United States Patent [19]

Shafer

[11] 4,278,403

[45] Jul. 14, 1981

[54] CONTROL FOR HYDRAULIC ACCUMULATOR SYSTEM

[76] Inventor: Jon L. Shafer, 13719 Cricket Hollow Dr., Houston, Tex. 77069

[21] Appl. No.: 72,903

[22] Filed: Sep. 6, 1979

[51] Int. Cl.[3] ..... F04B 49/02

[52] U.S. Cl. ..... 417/38; 60/418

[58] Field of Search ..... 417/36, 38, 540, 542, 417/543, 544; 60/415, 416, 418

[56] References Cited

U.S. PATENT DOCUMENTS

| | | | |
|---|---|---|---|
| 2,507,987 | 5/1950 | Luster | 417/38 X |
| 2,773,455 | 12/1956 | Mercier | 417/540 |
| 2,810,496 | 10/1957 | Gray | 417/540 X |
| 3,493,001 | 2/1970 | Bevandich | 417/38 X |
| 3,738,775 | 6/1973 | Strickland | 417/38 |
| 3,768,925 | 10/1973 | Klemm | 417/38 X |

*Primary Examiner*—Carlton R. Croyle
*Assistant Examiner*—Edward Look
*Attorney, Agent, or Firm*—Hamilton, Renner & Kenner

[57] ABSTRACT

A hydraulic accumulator system comprising an accumulator tank (22) for storing hydraulic fluid supplied by a pump (P) from reservoir (10), the stored fluid being pressurized by gas from gas tank (28), a control tank (35)connected at one end to the fluid supply (10) and at the other end to the gas supply (28), and a piston (36) in said control tank (35) having differential areas exposed to said fluid and said gas, said piston having means (41) for actuating a switch (43) to control said pump (P).

5 Claims, 2 Drawing Figures

CONTROL FOR HYDRAULIC ACCUMULATOR SYSTEM

TECHNICAL FIELD

Hydraulic systems utilizing hydraulic fluid under pressure to operate equipment such as hydraulic operators for pipeline valves, wherein the pressurized fluid is stored in an accumulator which is charged by a pump controlled by the pressure or volume of hydraulic fluid in the accumulator.

BACKGROUND ART

An accumulator in conventional hydraulic systems in this field consists of a tank containing hydraulic fluid such as oil under the pressure of an inert gas blanket such as nitrogen on top of the fluid. It is usually preferred to separate the gas from the oil by a piston having an elastomeric seal around its periphery to prevent entrainment of gas into the oil. A pump is connected in the system to suck low pressure oil from a reservoir connected to the return line and discharge the oil into the bottom of the accumulator at a high flow rate against the top gas pressure, thereby building up the pressure of the oil stored therein. The stored oil at high pressure is connected to the power line of the system for operating the equipment when conditions require, and a sensing device such as a pressure-actuated switch is connected in the line for controlling the pump motor. A hydraulic pressure relief valve is connected to the stored oil in the accumulator to protect the system from excessive pressure in the event of malfunction of the pressure-actuated switch.

It is desirable that the full capacity of the accumulator tank be utilized to store hydraulic fluid under pressure and that the pump motor be shut off when the piston reaches the top of the cylinder. However, conventional pressure-actuated switches have a substantially wide range between make and break connections.

A number of disadvantages have been experienced with accumulators in conventional systems resulting from inaccurate control of the piston as it reaches the top of the accumulator such that the pressure of the oil continues to build up (sometimes referred to as "top out,") or the pump is shut off prematurely before the piston reaches the top.

For example, if the pressure builds up due to top out, a pressure differential is created across the elastomeric seal around the piston, causing seal extrusion and reducing the life of the seal.

Also, if the piston is allowed to top out, the system becomes what may be called a "hard" system, leaving no room for thermal expansion of the hydraulic fluid and causing the pressure relief valve to open. Once the relief valve has opened it may not reseat properly when the system is restored to normal operation, and leakage of the hydraulic fluid may consequently occur.

These problems are aggravated in accumulator systems out-of-doors, as weather conditions may cause the inert gas to shrink and allow the piston to top out, or cause excessive thermal expansion of the hydraulic fluid, resulting in top out.

If the pressure-actuated switch acts to shut off the pump prematurely before the piston reaches the top of the accumulator, a loss of accumulator capacity for storing the desired amount of hydraulic fluid under pressure results. Moreover, due to the wide range between on and off positions if the pressure-actuated switch, a large volume of the fluid stored in the accumulator may be consumed before the switch starts the pump to replenish the fluid.

DISCLOSURE OF INVENTION

The present invention overcomes the foregoing problems and disadvantages by providing a hydraulic accumulator system having a novel control for the hydraulic pump responsive to volume displacement of the hydraulic fluid to accurately stop the accumulator piston at the optimal position.

It is an object of the present invention to provide a novel control for a hydraulic accumulator system which prevents excessive pressure buildup in the accumulator.

Another object is to provide a novel control which utilizes the full capacity of the accumulator to store hydraulic fluid under pressure.

A further object is to provide a novel control which allows thermal expansion of hydraulic fluid in the system without top out in the accumulator.

Another object is to provide a novel control which compensates for shrinkage of the gas used to pressurize the accumulator.

A still further object is to provide a novel control which positively assures an optimal amount of stored oil in the accumulator at optimal pressure.

These and related objects are accomplished by the improvements comprising the invention, a preferred embodiment of which is disclosed herein as exemplifying the best known mode of carrying out the invention. Various modifications and changes in details of construction and operation are comprehended within the scope of the appended claims.

PREFERRED EMBODIMENT FOR CARRRYING OUT THE INVENTION

Figure 1:
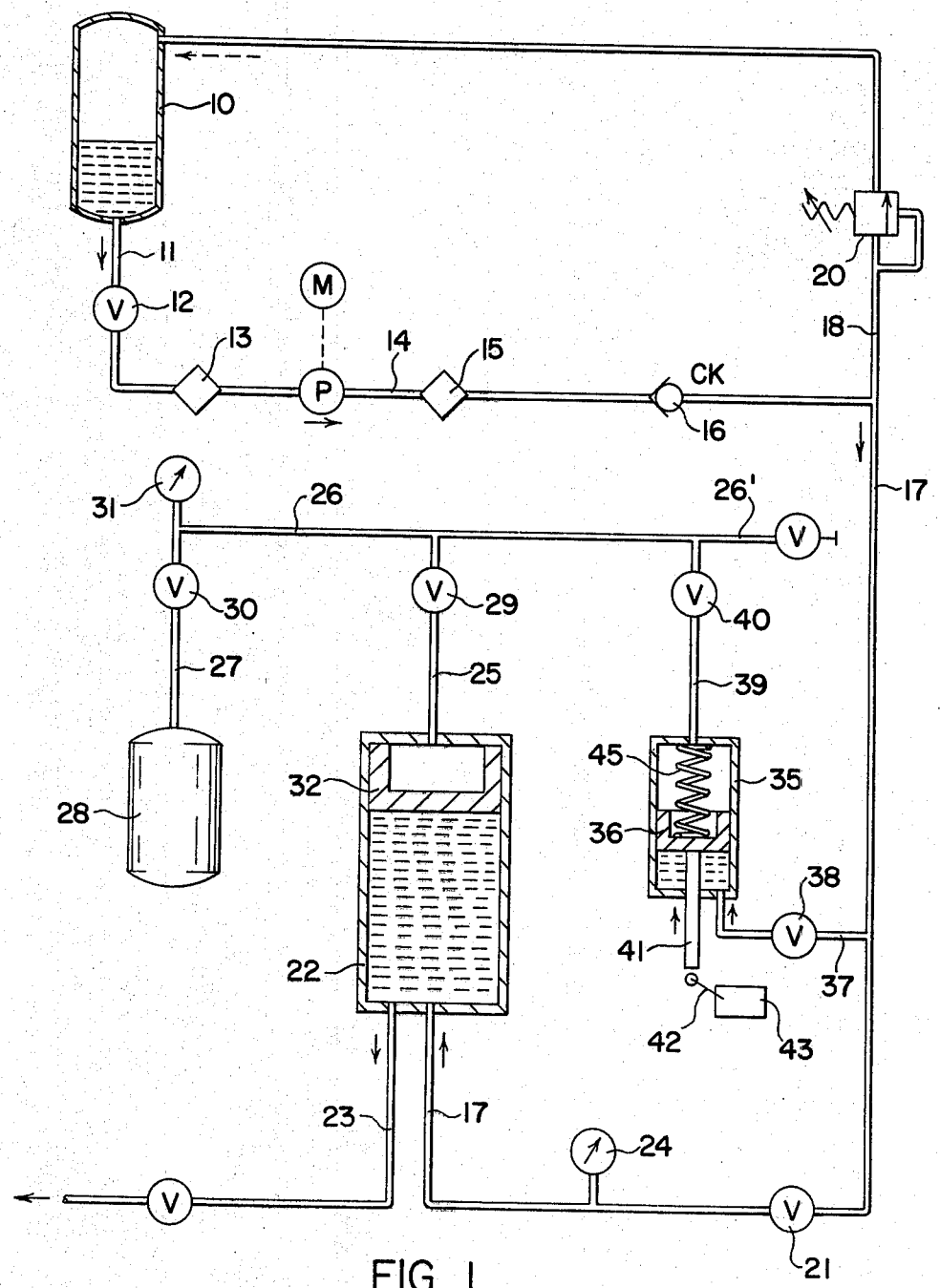
FIG. 1 is a schematic layout of a hydraulic accumulator system embodying the novel volume displacement control.

Referring to FIG. 1, the hydraulic system includes a storage tank or reservoir 10 for storing hydraulic fluid at low pressure, and used to supply or replenish hydraulic fluid in the system. Fluid from the bottom of tank 10 is sucked through a conduit 11, valve 12 and filter 13 by a pump P driven by a motor M which may be electric or pneumatic.

The pump forces hydraulic fluid through conduit 14, filter 15 and check valve 16 into conduit 17. A return conduit 18 is connected to conduit 17 and is connected at its other end to the top of tank 10. A normally closed pressure relief valve 20 is connected in the conduit 18 and is set to open at a predetermined pressure in excess of the pressure created by the pump in line 14.

The supply conduit 17 is connected through a normally open valve 21 to the bottom of an accumulator tank 22 used to store hydraulic fluid under high pressure to be delivered when required through discharge conduit 23 at high hydraulic flow rates. This may be when requirements are in excess of the GPM rating of the pump P used to charge the accumulator tank 22, and/or when the pump fails to operate. A pressure gauge 24 is connected into line 17.

Figure 2:
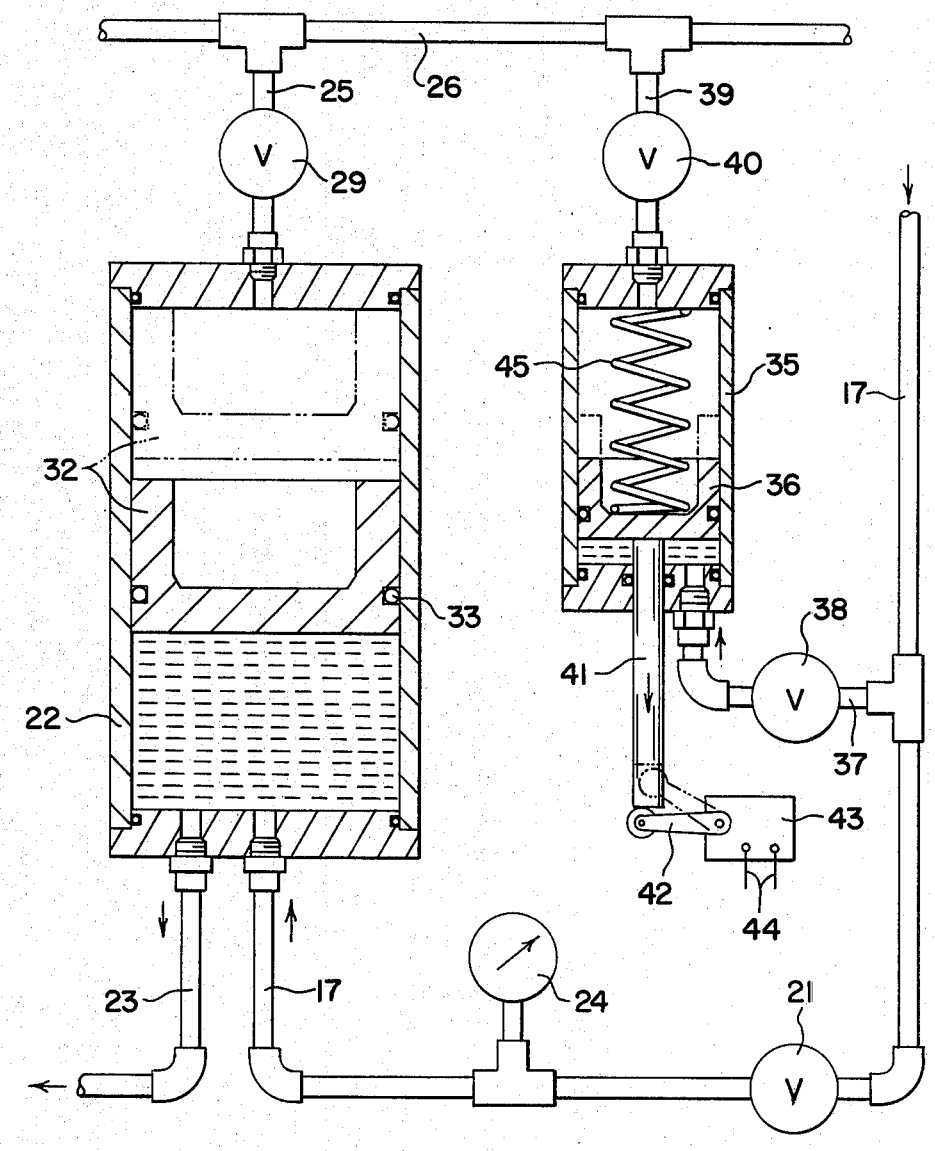
FIG. 2 is an enlarged schematic view of the accumulator and the novel volume displacement control connected thereto.

The top of accumulator tank 22 is pressurized by an inert gas such as nitrogen supplied by interconnected conduits 25, 26 and 27 from gas storage tank 28. Suitable hand valves 29 and 30 are connected into lines 25 and 27, respectively, for purposes of isolation and maintenance, and a pressure gauge 31 is connected to line 27. Preferably, the hydraulic fluid in accumulator tank 22 supplied by line 17 is separated from the pressurized gas blanket supplied by line 25 by a pistion 32 having an elastomeric seal 33 (FIG. 2) around its periphery, in order to inhibit entrainment of the gas into the hydraulic fluid.

The system thus far described is more or less conventional, and a pressure-actuated switch (not shown) is normally connected in line 17 or line 23 to control the operation of the pump P. The pump P pumps oil from reservoir 10 into the bottom of accumulator tank 22 against the pressure of the gas from gas storage tank 28. The optimum time for shutting off the pump is when the piston 32 reaches or nears the top of the cylinder, and the conventional pressure-actuated switch is used to perform this function. However, as previously discussed the wide range between make and break connections in such switches renders them unreliable as an accurate sensing device, so that excessive pressure may be built up in the accumulator before the pump stops, or the pump may be shut off too soon. In either case a number of problems and disadvantages previously enumerated may result.

According to the present invention, the pressure-actuated switch is eliminated and a novel sensing device is connected to the supply line 17 which functions by volume displacement accurately to stop the pump when the accumulator tank is filled and the piston therein reaches the top of the accumulator tank. The novel sensing device may be termed a pilot or control accumulator tank indicated at 35 preferably having a piston 36 therein, and connected at the bottom to supply line 17 by a conduit 37 having a valve 38 therein. The top of the tank 35 is connected by a conduit 39 to gas supply conduit 26 and has a valve 40 therein. The line 26 may be extended as indicated at 26′ for connection to additional accumulator tanks.

The piston 36 has a depending stem 41 which extends slidably through a suitable seal in the bottom wall of tank 35, and is adapted to actuate the trigger arm 42 of a normally open switch 43 (which may be electric or pneumatic) controlling the operation of pump P. As shown schematically in FIG. 2, the switch 43 may have electrical conductors 44 which connect the switch to the pump motor M. The presence of the stem 41 reduces the bottom area of the piston 36 exposed to the hydraulic fluid as compared with the top area exposed to the gas pressure from conduit 39. A pneumatic or mechanical compression spring 45 may be interposed between the top of piston 36 and the top wall of the tank 35. The piston 36 may be replaced by a pressure-movable element such as a float pressurized on its upper surface by a compression spring and adapted when raised to actuate a magnetic switch on the exterior of cylinder 35 to control the pump.

In the operation of the improved system, as the pump P forces hydraulic fluid into the accumulator tank 22, hydraulic fluid is introduced into the tank 35 at the same flow rate. When the piston 32 rises, the piston 36 will not rise immediately due to the differential top and bottom areas and/or the effect of compression spring 45 when used. In the full line position of piston 36 shown in FIG. 2 the stem 41 is holding the arm 42 to close the switch and operate the pump. The differential areas of the piston are calculated so that when piston 32 reaches the top of cylinder 22, the increase in volume of hydraulic fluid in tank 35 due to differential pressure takes place substantially instantaneously, causing the piston 36 to rise and immediately allow the trigger arm 42 to rise and shut off the pump. The spring 45 may be used to increase the differential effect.

The piston 36 rises only a short distance before allowing the switch 43 to shut off the pump so that in the event of thermal expansion of the hydraulic fluid in the system the remaining capacity of the control cylinder is available to help compensate for it.

When the stored hydraulic fluid in tank 22 is dispensed through conduit 23 due to a demand downstream; for example, to close pipeline valves in the event of a line break, the consequent drop in pressure in line 17 will first reduce the volume of fluid in tank 35 and lower the piston 36 due to the differential areas, so that the piston will descend in advance of piston 32 and start the pump immediately to replenish the discharging fluid with fluid from reservoir 10.

The pilot accumulator 35 operates as a sensing device to accurately control the pump to prevent a high pressure differential across the seal 33 of the piston 32 in accumulator tank (or tanks) 22 due to fluid flow from the pump after piston 32 reaches the top of the tank, as well as due to thermal expansion of the hydraulic fluid.

The improved pilot accumulator control assures that:

(1) all accumulator tanks are kept filled to capacity;
(2) maximum accumulator tank capacity is available to compensate for thermal expansion;
(3) the pump is started after minimal fluid loss from the accumulator tanks;
(4) pressure differential across the piston seals in the accumulator tanks is minimized at all times;
(5) the system is self-compensating for thermal expansion of hydraulic fluid and pressurized gas supply.

I claim:

1. In a hydraulic accumulator system having an accumulator tank for storing hydraulic fluid under a piston biased by pressurized gas and a pump for supplying fluid to said tank, a control tank connected at one end to said fluid supply and at the other end to said pressurized gas, a pressure-movable partition element in said control tank having differential areas exposed to said fluid and said gas, and a switch operatively connected to said pump, said partition element having means for actuating said switch to stop the pump immediately when the accumulator tank becomes filled with pressurized hydraulic fluid and to start the pump immediately when said fluid begins to discharge from said accumulator tank.

2. In a hydraulic accumulator system as described in claim 1, wherein the pressure-movable element in said control tank is a piston having a stem extending exteriorly of said control tank for engaging the switch controlling said pump.

3. In a hydraulic accumulator system as described in claim 2, wherein a compression spring pressurized the piston in said control tank on the gas side of said piston.

4. In a hydraulic accumulator system having an accumulator tank for storing hydraulic fluid under a piston biased by pressurized gas and a pump for supplying fluid to said tank, a control tank connected at one end to said fluid supply and at the other end to said pressurized gas, a pressure-movable partition element in said control tank having opposite areas exposed to said fluid and said gas, and a switch operatively connected to said partition pump, said element having means for actuating said switch to stop the pump immediately when the accumulator tank becomes filled with pressurized hydraulic fluid and to start the pump immediately when said fluid begins to discharge from said accumulator tank.

5. In a hydraulic accumulator system as described in claim 4, wherein a compression spring pressurizes the pressure-movable element on the side exposed to said gas.

* * * * *

UNITED STATES PATENT AND TRADEMARK OFFICE

CERTIFICATE OF CORRECTION

PATENT NO. 4,278,403

DATED July 14, 1981

INVENTOR(S) : JON L. SHAFER

It is certified that error appears in the above-identified patent and that said Letters Patent are hereby corrected as shown below:

Column 1, line 68, "if" should read --in--.

Column 4, line 63, "pressurized" should read --pressurizes--.

Column 5, line 5, "partition pump, said element" should read --pump, said partition element--.

Signed and Sealed this

*Second* Day of *February 1982*

[SEAL]

*Attest:*

GERALD J. MOSSINGHOFF

*Attesting Officer*

*Commissioner of Patents and Trademarks*